US005889395A

United States Patent [19]

Lundberg

[11] Patent Number: 5,889,395

[45] Date of Patent: Mar. 30, 1999

[54] INTEGRATED LOW VOLTAGE REGULATOR FOR HIGH CAPACITIVE LOADS

[75] Inventor: Martin B. Lundberg, Milton, Vt.

[73] Assignee: International Business Machine Corporation, Armonk, N.Y.

[21] Appl. No.: 49,270

[22] Filed: Mar. 27, 1998

[51] Int. Cl.[6] ..... G05F 3/26

[52] U.S. Cl. ..... 323/313; 323/315; 323/316

[58] Field of Search ..... 323/313, 314, 323/315, 316, 280, 273, 282; 327/530, 535, 538, 541

[56] References Cited

U.S. PATENT DOCUMENTS

| | | | |
|---|---|---|---|
| Re. 35,261 | 6/1996 | Nelson | 330/257 |
| 4,703,249 | 10/1987 | De La Plaza et al. | 323/316 |
| 4,912,393 | 3/1990 | Anderson et al. | 323/313 |
| 4,952,863 | 8/1990 | Sartwell et al. | 323/280 |
| 5,180,932 | 1/1993 | Bengel | 307/353 |
| 5,512,814 | 4/1996 | Allman | 323/267 |
| 5,559,424 | 9/1996 | Wrathall et al. | 323/277 |
| 5,563,501 | 10/1996 | Chan | 323/282 |
| 5,654,665 | 8/1997 | Menon et al. | 327/541 |
| 5,686,821 | 11/1997 | Brokaw | 323/273 |
| 5,739,681 | 4/1998 | Allman | 323/314 |

*Primary Examiner*—Adolf Deneke Berhane
*Attorney, Agent, or Firm*—Thornton & Thornton; Francis J. Thornton; Robert A. Walsh

[57] ABSTRACT

An improved, high performance differential voltage regulator for high capacitance loads using a transistor-capacitor that will, while operating with voltages below 5 volts, have wide bandwidth, high current, and loop stability over a to a wide range of output capacitive loads.

The regulator achieves this through first and second control loops coupled to a first one of a pair of differential transistors 2. The first of said control loops sends the output of the regulator to the gate of the first one of the differential transistors while the second of said control loops comprises a control transistor coupled to a transistor-capacitor and to a current mirror transistor controlled by the second differential transistor such that the output voltage may be compared to a reference voltage driving the first differential transistor to generate a differential current and provide differential voltage drives , via a current mirror, to the gate of the output transistor to provide an output capable of driving the gate of the output transistor from ground to voltage thereby providing wide bandwidth, high current, and loop stability to the circuit.

19 Claims, 4 Drawing Sheets

INTEGRATED LOW VOLTAGE REGULATOR FOR HIGH CAPACITIVE LOADS

FIELD OF THE INVENTION

This invention relates generally to regulator circuits and, more particularly, to an integrated low voltage regulator circuit designed for use with semiconductor modules that will supply current to high capacitive load or modules while maintaining wide bandwidth, high current and loop stability.

BACKGROUND OF THE INVENTION

Voltage regulator circuits are currently and widely used to supply a set voltage level to electronic devices. When used with semiconductor circuits and modules, such as DRAMs (Dynamic Random Access Memories) that require a wide bandwidth, high current, and loop stability while supplying current to high capacitive loads, known voltage regulator circuits have been found to be inadequate especially for applications that use input voltages below 5 volts or output voltages below 3 volts.

A common way of maintaining loop stability in low voltage applications is by using either excessively large chip areas or by accepting lower circuit performance. An attempt to provide better circuit performance used a lag-lead resistor-capacitor arrangement commonly known as a Miller compensation circuit in which a resistor and a capacitor are arranged in series between the gate and the output of the output transistor.

These Miller compensation circuits have problems especially when used with large integrated circuits, logic or memory, having large load capacitances, such as DRAMs or BASIC, and requiring high current and fast response times. In DRAMs, the Miller compensation circuit required becomes unacceptably large resulting in an unacceptable bandwidth and the introduction of additional low frequency poles into the system which further adversely affect the performance of the voltage regulator.

Also, in such integrated circuit applications, low input voltages with a low input to output voltage requires a large voltage swing across the gate to source of the output transistor further limiting the size and type of capacitive device that can be used. For example, the large voltage swing requires the Miller capacitor to function with reversible polarity thus precluding the use of devices such as thin oxide capacitors typically used in integrated circuits and requiring instead that the capacitor to be a metal capacitor which is substantially larger than such thin oxide capacitors.

Additionally, in such low voltage applications, cascade stages, which would permit the use of still smaller compensation capacitors, can not be used to boost the current source impedance. Since such regulators require a large output transistor and the Miller compensation scheme requires the Miller capacitance to be substantially larger than the gate-drain capacitances of the output transistor, the Miller compensation scheme cannot be implemented in a practical design.

Still another prior art attempt employed respective parallel resistor-capacitor arrangements coupled to the source of each of the differential input transistors to provide lead compensation. In both this latter arrangement and in the Miller compensation scheme, the large output load capacitance is used as a dominant pole and the output drive circuit contributes a second pole to the circuit. Although this regulator works well with a 5 volt input voltage and a 3.3 output voltage it fails at lower voltages for it cannot maintain sufficient voltage across the capacitors and still provide an adequate voltage swing on the gate of the output device.

Accordingly when faced with these problems, the prior art could only degrade the performance of the entire integrated circuit and thus limit the conditions that would generate these problems.

Therefore to achieve the smallest chip size and to utilize the full performance capabilities of such integrated circuits, there now exists a need for a new and improved voltage regulator circuit which avoids all the above described problems associated with the prior art low voltage regulators used in large integrated circuits while achieving the full performance of the circuit, especially when employing input voltages below 5 volts.

The present invention avoids all the above described problems associated with the prior art circuits and achieves small size and full circuit performance at low input voltages, especially input voltages below 5 volts, and other desirable results by comparing, in a differential amplifier, the regulator circuit output to a reference voltage and generating a differential current to provide a current drive to the gate of a control transistor, which is, in turn, driven by second and third current sources capable of driving the control transistor from ground to voltage.

SUMMARY OF THE INVENTION

It is therefore an object of the present invention to provide an improved voltage regulator circuit which provides a wide bandwidth, high current and loop stability while supplying current to high capacitive loads.

These desirable results and other objects and advantages, of the present invention, are realized and provided by, an improved voltage regulator circuit having a capacitively loaded output. The regulator circuit comprises a differential pair of transistors, coupled to a common current source, the first one of the pair of differential transistors being biased by a reference voltage source and controlling a first current mirror, the other of said differential transistors being biased, via a first feedback loop, by the output of the regulator and controlling a second current mirror, the first current mirror being further coupled to an transistor-capacitor and, through a control transistor, controlling a third current mirror that drives an output transistor coupled to the circuit output that, via said first feedback loop, biases the second of the pair of differential transistors and, via a second feedback loop, that includes the transistor-capacitor, drives the gate of the control transistor from ground to voltage to maintain wide bandwidth, high current and loop stability in the regulator.

These and other objects, features, and advantages of the invention will be apparent from the following more particular description of the preferred embodiment of the invention as illustrated in the accompanying drawings.

DESCRIPTION OF THE PREFERRED EMBODIMENT

Basically, the present invention, as will be more fully set forth below, describes an improved voltage regulator arrangement having means for comparing the regulator circuit output to a reference voltage and generating a differential current to provide a current drive to the gate of an power transistor serving as an output transistor coupled to a large capacitive load. This output transistor is driven by a pair of current sources coupled to a transistor-capacitor coupled between selected voltages, e.g. a positive voltage and ground. The drive voltage applied to the output transistor ranges between the selected voltages, as needed, via a pair of feedback loops thereby providing a voltage regulator circuit having a wide bandwidth, a high current capability and loop stability while supplying large currents to large capacitive loads.

Figure 1:
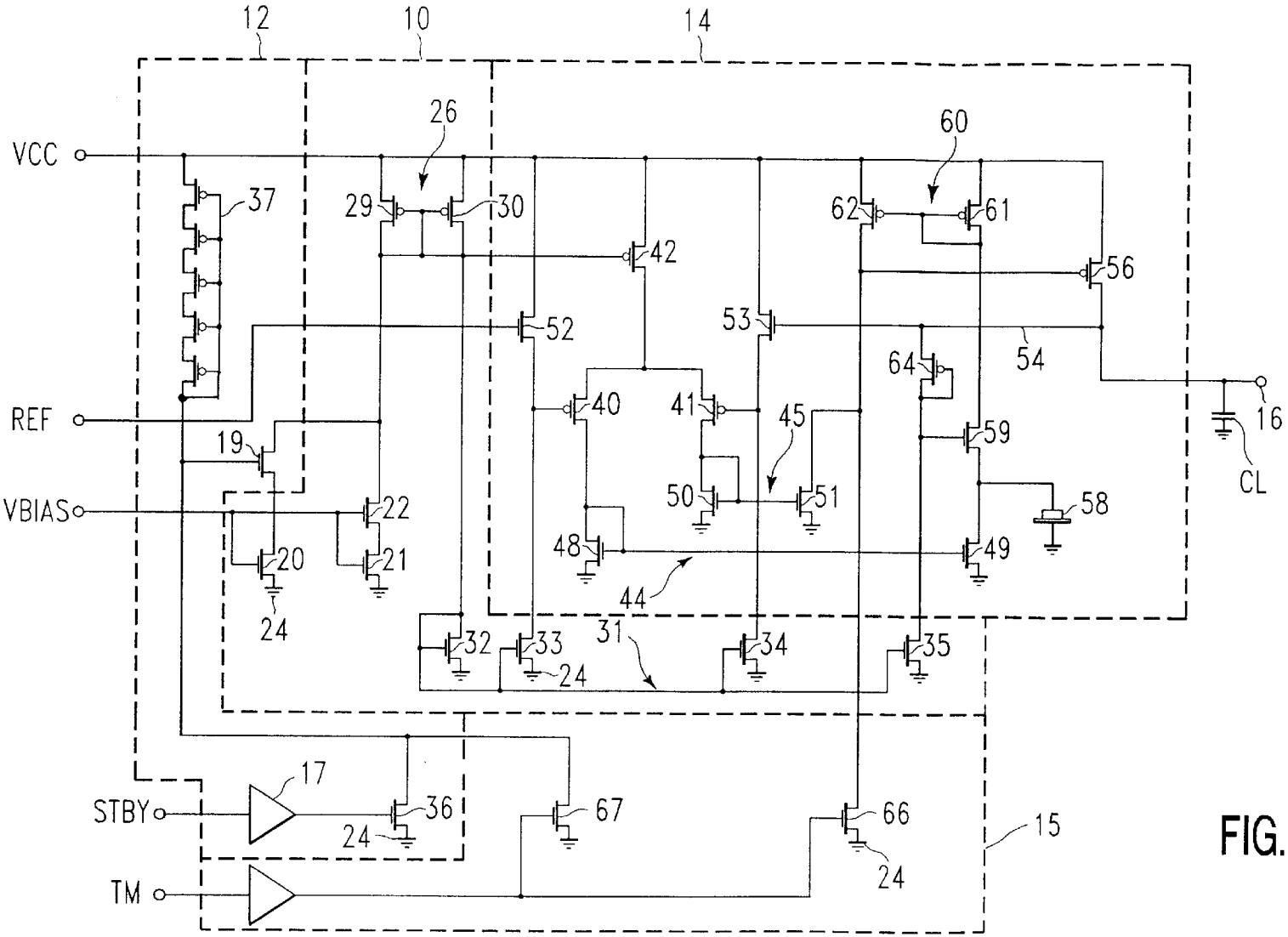
FIG. 1 shows, in schematic form, the voltage regulator of the present invention as actually built using PMOS transistors in the differential amplifier and an Nwell NMOS capacitor-transistor.

Referring now to FIG. 1, the regulator of the present invention and its operation will be described.

The voltage regulator of the present invention as actually built comprises a bias input circuit 10, an enable circuit 12 for driving a unique differential stage circuit 14 which is coupled to a capacitively loaded output line 16 and a test circuit 15.

The input bias circuit 10 comprises a voltage source VBIAS connected to the gates of three NMOS field effect transistors 20, 21 and 22 which are coupled between ground 24 and a current mirror 26 comprised of PMOS transistors 29 and 30 in the bias input circuit 10 and transistor 42 in the differential stage circuit 14. The current mirror 26 is used to set the current in another current mirror 31 comprised of a plurality of NMOS transistors 32, 33, 34 and 35 that serve as current sources. The NMOS transistors 32, 33, 34 and 35 serve as current sources for various portions of the differential amplifier circuit 14 as will be described below.

The standby circuit 12 comprises a standby signal source (STBY) coupled, through an inverter circuit 17, to an NMOS switching transistor 36 whose source is connected to ground 24 and whose drain is coupled to the gate of a switching transistor 19 and to a chain 37 of PMOS transistors coupled between the drain of transistor 36 and a positive voltage source VCC. The chain 37 serves as a resistor.

The differential circuit 14 is comprised of a pair of differential PMOS field effect transistors 40 and 41 coupled between a current source 42 and first and second current mirrors 44 and 45 formed respectively of pairs of NMOS field effect transistors 48 and 49 and transistors 50 and 51. The gates of the differential transistors 40 and 41 are, coupled through respective PMOS voltage equalizing field effect transistors 52 and 53 to the voltage source VCC and respectively through the current source transistors 33 and 34 to ground 24.

The differential transistors 40 and 41 have their sources coupled together and, through the current source 42, are further coupled to the positive voltage source VCC. The drain of differential transistor 40 is coupled, to the gates of both current mirror transistors 48 and 49, which form the current mirror 44, and to the drain of transistor 48. The sources of the current mirror transistors 48 and 49 are both coupled to ground.

Similarly, the drain of differential transistor 41 is coupled to the gates of the transistors 50 and 51, which form the second current mirror 45, and to the drain of transistor 50. The sources of transistors 50 and 51 are also both coupled to ground.

The gate of the differential transistor 40 is coupled to the source of a voltage equalizer or voltage level shifting transistor 52 and through it to VCC. The gate of the voltage equalizer transistor 52 is coupled to a reference voltage REF. The gate of the differential transistor 40 is further coupled through the NMOS current transistor 33 to ground.

Similarly, the gate of the differential transistor 41 is coupled to the source of voltage equalizer transistor 53 whose gate is coupled, via a feedback line 54, to the capacitively loaded circuit output 16 and to the drain of a PMOS output transistor 56. The drain of the voltage equalizer circuit transistor 53 and the source of the output transistor are both coupled to the voltage source VCC. The gate of the differential transistor 41 is also further coupled through the NMOS current transistor 34 to ground.

The drain of transistor 49, in the current mirror 44, is connected to the gate of a thin oxide NMOS transistor-capacitor 58. Typically such transistor-capacitors are formed, in integrated circuits, in a manner identical to forming a field effect transistor, with a gate element and a source and drain. However, by connecting the source and drain of the transistor to its own substrate, it cannot act as a transistor and when the gate element is connected to a first potential or voltage and the substrate connected to a second potential or voltage, e. g. ground, a capacitor is realized. Such transistor-capacitors can also be N-well NMOS devices. The drain of transistor 49 is further connected to the source of transistor 59. The drain of transistor 59 is connected to the drain of a PMOS transistor 61 and to the gates of both PMOS transistor 61 and PMOS transistor 62. The sources of both PMOS transistors 61 and 62 are coupled to the voltage source VCC. Together the transistors 61 and 62 form still another current mirror 60.

The gate of control transistor 59 is connected through a diode coupled transistor 64 to the feedback line 54 and thus to the output 16 and the gate of the voltage equalizer transistor 53. The gate of control transistor 59 is also coupled through the current source transistor 35 to ground.

The diode coupled transistor 64, the control transistor 59 and the thin oxide transistor-capacitor 58 together form a second feedback loop to provide additional voltage control to the gate of the output transistor 56 via the current mirror 60.

This second feedback loop does not affect the DC operation of the circuit for the turn off current from the second differential input stage flowing through transistor 41, for as will be later described, current is passed through control transistor 59 and provides a bias in this second feed back loop to set the small signal gain of the control transistor 59.

The drain of current mirror transistor 62 is connected to the gate of the output transistor 56, to the drain of transistor 51 in the second current mirror 45 and to ground through a switching transistor 66 driven by a selective test mode input TM.

The voltage regulator of the present invention, as shown in FIG. 1, thus has a differential stage basically comprised of a pair of differential field effect transistors (FETs) whose gates respectively are coupled, through voltage equalizer transistors, to a reference voltage source and the regulated output. Both differential transistors have their sources coupled together and, through a current source, to a positive voltage source which is higher than ground. The differential transistors drive respective first and second current mirrors.

The gate of one of the differential transistors is further coupled to a control transistor, through the voltage equalizer transistor coupled thereto, and then to a thin oxide transistor-capacitor.

This voltage equalizer circuit, control transistor and the thin oxide transistor-capacitor together form a second feedback loop to control the gate voltage applied to the gate of the output transistor via a still another current mirror.

This second feedback loop does not affect the DC operation of the circuit for the turn off current from the second differential input stage is sufficient to provide a bias current for this second feed back loop to control the small signal gain of the control transistor.

The above described voltage regulator circuit operates as follows. When the circuit in standby, the voltage source VBIAS, and the reference voltage source REF each have a fixed positive voltage level applied there to and the standby source (STBY) is normally held low. In this quiescent state approximately 1 micro-amp of current is flowing through transistor 29 and transistors 21 and 22 of the bias circuit. This means, by virtue of the current mirror relationship between transistors 29 and 42 that 20 micro-amps of current are flowing through the differential amplifier formed of transistors 40 and 41. Although transistor 20 is turned on no current flows there through because transistor 19 is off.

To activate the circuit, the standby source (STBY) goes high, i.e. positive, and, through the inverter 17, applies a negative voltage to the gate of the transistor 36 so that it turns off. When transistor 36 turns off the resistor chain 37 pull the voltage at the base of transistor 19 high, i. e., towards voltage VCC, and transistor 19 turns on to couple transistor 20 to the current mirror transistor 29 and draws an additional 9 micro-amps of current through the transistors 19 and 20 thus increases the current flow through the current mirror transistors 29 and 30. This causes the current source transistors 32, 33, 34, 35 and 42 to also pass more current.

When the reference voltage source REF is applying a positive voltage to the gate of the voltage equalizer transistor 52 and the output transistor 56 is on and applying a voltage to the gate of the equalizer transistor 53, the equalizer transistors 52 and 53 and the differential transistors 40 and 41 are all on and drawing current. If the voltage at the output 16 is not equal, e. g. is lower, than the reference voltage REF, transistor 41 will draw more current, which is reflected in the current mirror 45 such that the current mirror transistor 51 pulls down the gate of the output transistor 56 to cause transistor 56 to draw more current. When transistor 56 draws more current it raises the output 16 to the level of the reference voltage REF applied to the gate of transistor 52. Simultaneously the current in transistor 40 decreases causing the current through transistors 48 and 49, forming the current mirror 44, to be similarly reduced. The dropping off of current through transistor 49 causes the current in transistors 61 and 62, that form the current mirror 60, to also decrease and reduce the voltage such that the differential transistor 41 draws more current to remain in balance with transistor 40. When transistor 41 draws more current, the transistors 50 and 51, of current mirror 45, also draw more current which further aids in lowering the voltage on the gate of transistor 56 and increasing the current therethrough.

When output transistor 56 begins to supply more current, the voltage on the output 16 rises and is not only applied to the capacitively loaded output 17 but is also fed back, via the voltage equalizer transistor 53, to the gate of differential transistor 41 to compare the output voltage to the reference voltage and drive transistor 41 to force the differential amplifier back into balance.

Because the large load capacitor CL coupled to the output 16 can, and usually does, introduce an additional low frequency pole in the system, the characteristics of the control loop, comprising output 16, transistors 56, 53, the differential transistors 40 and 41, and current mirrors 44, 45, and 60, changes and becomes unstable. It is thus necessary to add a second control loop comprising the thin oxide transistor-capacitor 58 and transistors 59 and 64 to adjust, via current mirror 60, the voltage applied to the gate of the output transistor 56.

As noted above this second feedback loop does not affect the DC or low frequency operation of the circuit for the turn off current from the differential input stage is, without modification to the to the current Mirror 60, passed through transistor 59 while providing a bias current for this second feed back loop to control the small signal gain of the control transistor 59 and the output impedance of the current source transistor 49. The transistor 64 is connected as a diode and is used to adjust the bias voltage on the source of the control transistor 59 to assure that the device operates in the saturated region at low voltages, i. e., below 5 volts and to maintain, on the gate of the transistor-capacitor 58, a voltage sufficient to fully invert the channel of the transistor-capacitor 58 thus permitting the transistor-capacitor 58 to realize its full capability. In this way, the output impedance of current source transistor 49 is combined with the gate capacitance of transistor-capacitor 58 and provides sufficient compensation for the open loop transfer function.

The test mode circuit 15 comprises the input TM and transistors 66 and 67 and is used to disable the regulator and turn on the power transistor 56 shorting the input voltage VCC to the output 16.

Thus there has been taught a voltage regulator circuit in which voltages from an output transistor, via a first control circuit, are differentially introduced into a PMOS transistor based differential amplifier to control the output transistor while simultaneously using the same data to further control the output transistor via a second control loop to enhance the circuit performance and insure stability in the regulator circuit.

Figure 2:
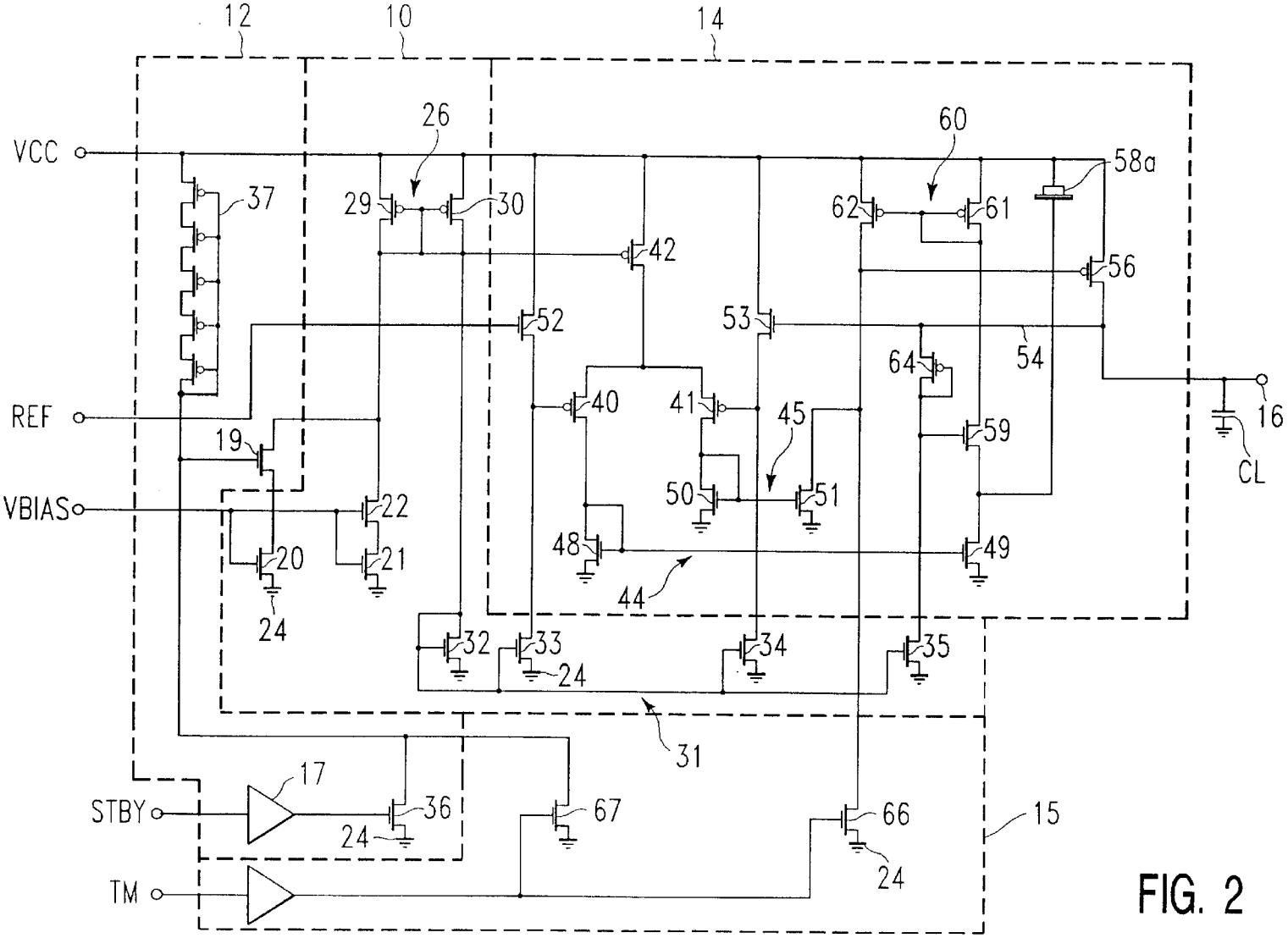
FIG. 2 shows in schematic form the voltage regulator of FIG. 1 in which a Pwell PMOS capacitor-transistor is substituted for the Nwell NMOS capacitor-transistor.

FIG. 2 shows an different embodiment of the regulator of the present invention. In this embodiment a PMOS capacitor-transistor 58*a* is used in place of the NMOS transistor capacitor 58 shown in FIG. 1. Because this newly substituted capacitor-transistor 58*a* is different in conductivity from that of capacitor-transistor 58, it is necessary that transistor-capacitor 58*a* be connected between the source of the output transistor 56 and both the drain of transistor 49 and the source of transistor 59. The remainder of the devices and their operations remain identical to FIG. 1 and hence bear identifying numbers identical to those in FIG. 1. It should also be noted that the operation of the circuit of FIG. 2 is identical to that described in conjunction with of FIG. 1 above.

Figure 3:
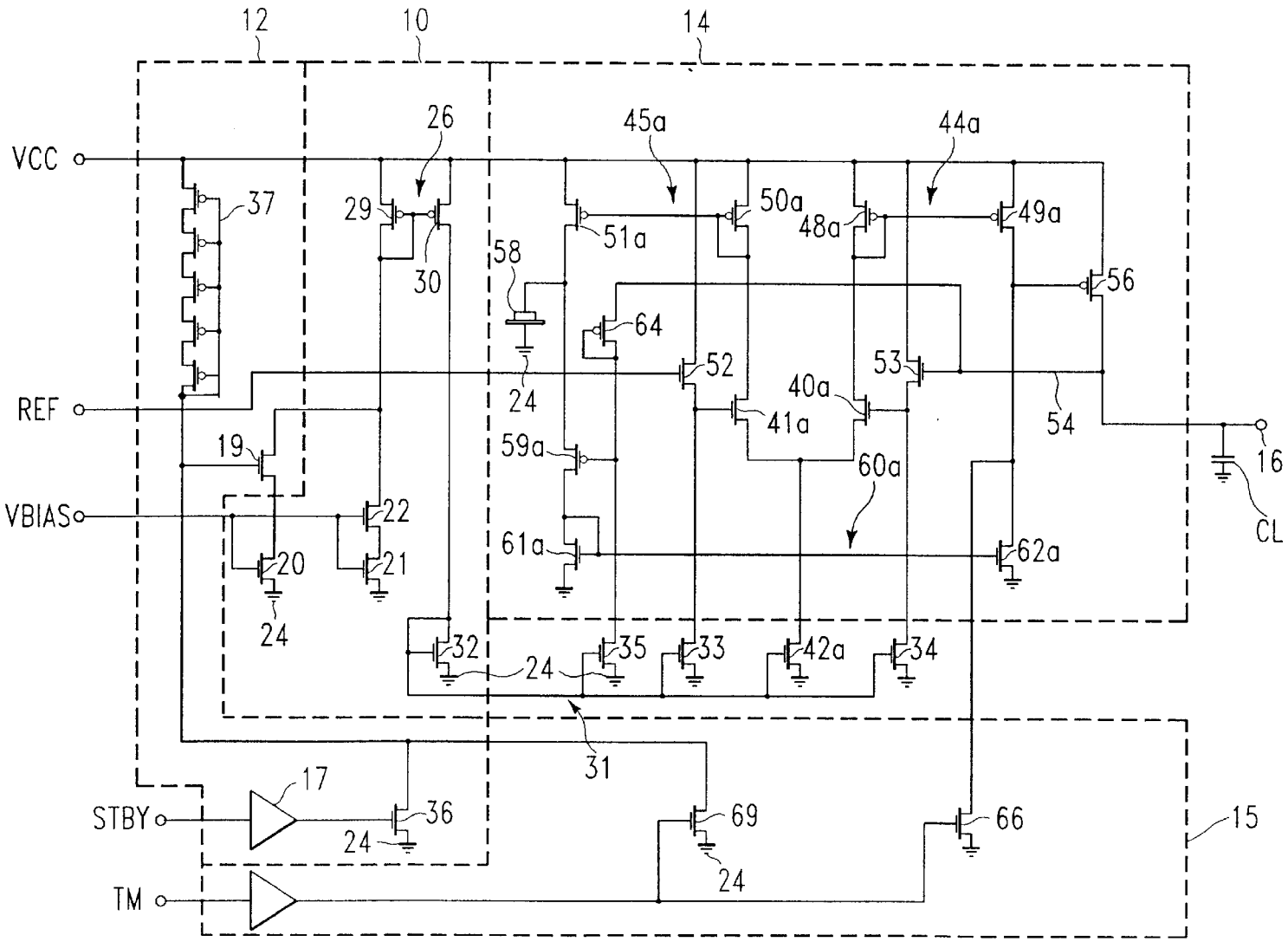
FIG. 3 shows in schematic form a different embodiment of the improved voltage regulator of the present invention using NMOS transistors in the differential amplifier and an Nwell NMOS capacitor-transistor.

Referring now to FIG. 3, still another different embodiment of the regulator of the present invention will be described. In this FIG. 3 like numbered devices or circuits denote devices identical to those shown in FIG. 1 and those numbered devices or circuits having an "a" thereafter are equivalent devices or circuits and may be of a different conductivity type.

The voltage regulator shown in this FIG. 3 again comprises a bias input circuit 10, an enable circuit 12 for driving a unique differential stage circuit 14 which is coupled to a capacitively loaded output line 16 and a test circuit 15.

The input bias circuit 10 again comprises a voltage source VBIAS connected to the gates of three NMOS field effect transistors 20, 21 and 22 which are coupled between ground 24 and a current mirror 26 comprised of PMOS transistors 29 and 30 in the bias input circuit 10. The current mirror 26 is used to set the current in another current mirror 31 comprised a plurality of NMOS transistors 32, 33, 34, 35 and 42*a* that serve as current sources. The NMOS transistors 32, 33, 34, 35 and 42*a* serve as current sources for various portions of the differential amplifier circuit 14 as will be described below.

The enable circuit 12 comprises a standby signal source STBY coupled, through an inverter circuit 17, to an NMOS switching transistor 36 whose source is connected to ground 24 and whose drain is coupled to the gate of the switching transistor 19 and to a resistor chain 37, formed of PMOS transistors, coupled between the drain of transistor 36 and a positive voltage source VCC.

The differential circuit 14 is comprised of a pair of differential NMOS field effect transistors 40*a* and 41*a* coupled between the current source transistor 42*a* and first and second current mirrors 44*a* and 45*a* formed respectively of pairs of PMOS field effect transistors 48*a* and 49*a* and transistors 50*a* and 51*a*. The gates of the differential transistors 40*a* and 41*a* are, coupled through respective PMOS voltage equalizing field effect transistors 52 and 53 to the voltage source VCC and respectively through the current source transistors 33 and 34 to ground 24.

The differential transistors 40*a* and 41*a* have their sources coupled together and, through the current source 42*a*, are further coupled to ground. The drain of differential transistor 40*a* is coupled, to the gates of both current mirror transistors 48*a* and 49*a*, which form the current mirror 44*a*, and to the drain of transistor 48*a*. The sources of the current mirror transistors 48*a* and 49*a* are both coupled to the positive voltage source VCC.

Similarly, the drain of differential transistor 41*a* is coupled to the gates of the transistors 50*a* and 51*a*, which form the second current mirror 45*a*, and to the drain of transistor 50*a*. The sources of transistors 50*a* and 51*a* are also both coupled to the positive voltage source VCC.

The gate of the differential transistor 41*a* is coupled to the sources of voltage equalizer transistor 52 and through it to VCC. The gate of the voltage equalizer transistor 52 is coupled to a reference voltage REF. The gate of the differential transistor 41*a* is further coupled through the NMOS current transistor 33 to ground.

Similarly, the gate of the differential transistor 40*a* is coupled to the source of voltage equalizer transistor 53 whose gate is coupled, via a feedback line 54, to the capacitively loaded circuit output 16 and to the drain of a PMOS output transistor 56. The drain of the voltage equalizer circuit transistor 53 and the source of the output transistor are both coupled to the voltage source VCC. The gate of the differential transistor 40*a* is also further coupled through the NMOS current transistor 34 to ground.

The drain of transistor 51*a*, in the current mirror 45*a*, is connected to the gate of a thin oxide NMOS transistor-capacitor 58. The drain of transistor 51*a* is further connected to the source of transistor 59*a*. The drain of transistor 59*a* is connected to the drain of an NMOS transistor 61*a* and to the gates of both NMOS transistors 61*a* and 62*a*. The sources of both transistors 61*a* and 62*a* are coupled to ground. Together the transistors 61*a* and 62*a* form still another current mirror 60*a*.

The gate of control transistor 59*a* is connected through a diode coupled transistor 64 to the feedback line 54 and thus to the output 16 and the gate of the voltage equalizer transistor 53. The gate of PMOS transistor 59*a* is also coupled through the current source transistor 35 to ground.

The diode coupled transistor 64, the control transistor 59*a* and the thin oxide transistor-capacitor 58 together form a second feedback loop to provide additional voltage control to the gate of the output transistor 56 via the current mirror 60*a*.

Again this second feedback loop does not affect the DC operation of the circuit for the turn off current from the second differential input stage flowing through transistor 40*a* for, as above described, current is passed through control transistor 59*a* and provides a bias in this second feed back loop to set the small signal gain of the control transistor 59*a*.

The drain of current mirror transistor 62*a* is connected to the gate of the output transistor 56, to the drain of transistor 49*a* in the second current mirror 44*a* and to ground through a switching transistor 66 driven by a selective test mode input TM.

The voltage regulator of the present invention is thus similar to that shown as shown in FIG. 1, except that it has a differential stage basically comprised of a pair of NMOS differential field effect transistors instead of PMOS transistors. Again similar to that shown in FIG. 1 the gates of these differential transistors 40*a* and 41*a* are respectively coupled, through voltage equalizer transistors, to a reference voltage source and the regulated output. Both differential transistors have their sources coupled together and, through a current source, to ground. The differential transistors drive respective first and second current mirrors. The gate of one of the differential transistors is further coupled to a control transistor, through the voltage equalizer transistor coupled thereto, and then to a thin oxide transistor-capacitor.

Figure 4:
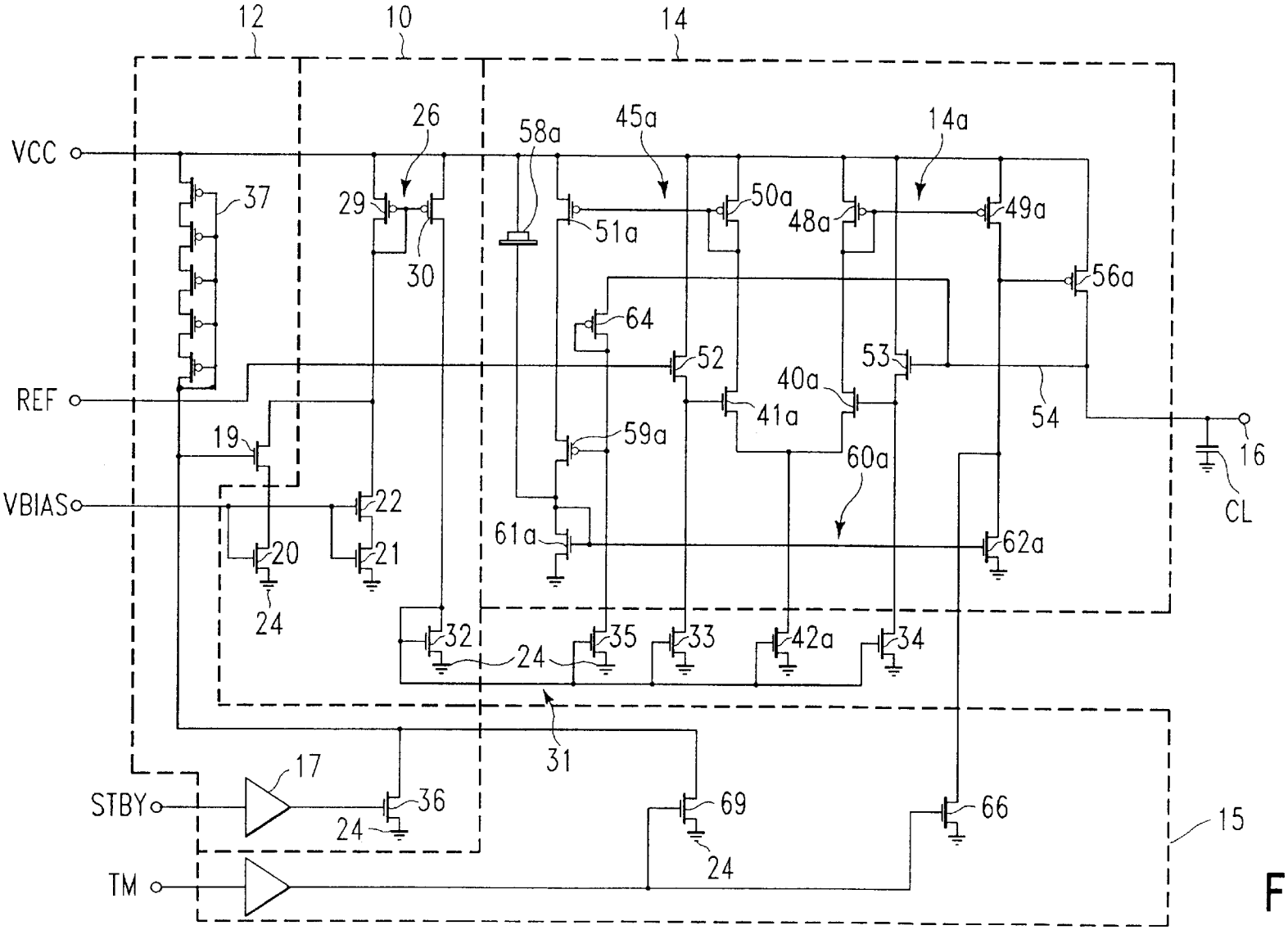
FIG. 4 shows in schematic form the voltage regulator of FIG. 3 in which a Pwell PMOS capacitor-transistor is substituted for the Nwell NMOS capacitor-transistor.

FIG. 4 shows an different embodiment of the circuit of FIG. 3. In this embodiment a PMOS capacitor-transistor 58*a* is used in place of the NMOS transistor capacitor 58 shown in FIG. 3. It should be noted that PMOS transistor 58*a* can be a P-well PMOS transistor. Because of this newly substituted capacitor-transistor 58*a* is different in conductivity from that of capacitor-transistor 58 it is necessary that transistor-capacitor 58*a* be connected to the drain of the control transistor 59*a* as shown in FIG. 3. The remainder of the devices and their operations remain identical to FIG. 3 and hence bear identifying numbers identical to those in FIG. 3.

In all these embodiments, the voltage equalizer circuit and the control transistor coupled thereto through the diode, together with the thin oxide transistor-capacitor form a second feedback loop to control the gate voltage applied to the gate of the output transistor via a current mirror.

This second feedback loop does not affect the DC operation of the circuit for the turn off current from the second differential input stage is sufficient to provide a bias current for this second feed back loop to control the small signal gain of the control transistor and thus eliminates the effect of any additional frequency pole created by the presence of large capacitor load coupled to the output.

The above described voltage regulator circuit operates in a manner substantially identical to that described above in conjunction with FIG. 1 and one skilled in the art can readily ascertain the details of its construction and the manner and mode of its operation.

This completes the description of the preferred embodiment of the invention. Since changes may be made in the above process without departing from the scope of the invention described herein, it is intended that all the matter contained in the above description or shown in the accompanying drawings shall be interpreted in an illustrative and not in a limiting sense. Thus other alternatives and modifications will now become apparent to those skilled in the art without departing from the spirit and scope of the invention as set forth in the following claims.

What is claimed is:

1. A voltage regulator having a capacitively loaded output comprising a differential amplifier having first and second differential transistors;

a control transistor;

a transistor-capacitor; and an output transistor;

said first and second differential transistors, said control transistor, and said output transistor each having respective control, input and output electrodes;

said transistor-capacitor having a first and second electrodes;

first and second current mirrors respectively coupled to the output electrodes of said first and second differential transistors;

said first differential transistor having its control electrode coupled to a reference voltage means;

the first of said current mirrors being further coupled to a third current mirror, to the control electrode of the control transistor and to the transistor-capacitor;

said second differential transistor having its control electrode coupled, via a first control loop, to the capacitively loaded output and the output electrode of the output transistor and, via a second control loop, to the first current mirror, the control transistor and the transistor capacitor; to drive, via said first and third current mirrors, the control electrode of the output transistor from ground to a voltage thereby providing wide bandwidth, high current, and loop stability to the voltage regulator circuit.

2. The regulator of claim 1 wherein said third current mirror is further coupled to the control electrode of said output transistor;

said output transistor has its input and output electrodes respectively coupled to a voltage source and said capacitively loaded output; and said second control loop is coupled to the output and to the control electrode of said output transistor.

3. The regulator of claim 2 wherein said second control loop is coupled to the control electrode of said output transistor through said third current mirror.

4. The regulator of claim 1 wherein said first differential transistor has its control electrode coupled to said reference voltage means through a voltage equalizer circuit.

5. The regulator of claim 1 wherein said second differential transistor has its control electrode coupled to said capacitively loaded output through a voltage equalizer circuit.

6. The regulator of claim 1 wherein there is further provided a biasing circuit having a fourth current mirror for setting the current in a plurality of current sources in the circuit.

7. The regulator of claim 1 wherein said differential transistors are PMOS transistors.

8. The regulator of claim 7 wherein the first of said current mirrors is coupled to the first electrode of the transistor-capacitor and the second electrode of said transistor-capacitor is coupled to ground.

9. The regulator of claim 7 wherein the first of said current mirrors is coupled to the second electrode of the transistor-capacitor and the first electrode of said transistor-capacitor is coupled to a positive voltage.

10. The regulator of claim 1 wherein said differential transistors are NMOS transistors.

11. The regulator of claim 10 wherein the first of said current mirrors is coupled to the first electrode of the transistor-capacitor and the second electrode of said transistor-capacitor is coupled to ground.

12. The regulator of claim 10 wherein the first of said current mirrors is coupled to the second electrode of the transistor-capacitor and the first electrode of said transistor-capacitor is coupled to a positive voltage.

13. A voltage regulator circuit having a capacitively loaded output comprising a differential amplifier having first and second differential transistors, each of said differential transistors having control electrodes and being coupled between a common current source and respective first and second current mirrors;

said first differential transistor having its control electrode coupled to a reference voltage;

the first of said current mirrors being further coupled to the source of a control transistor and to a first electrode of a thin oxide capacitor having a second electrode connected to ground;

the second of said current mirrors being further coupled to a third current mirror and to an output transistor having a control electrode;

said third current mirror being further coupled to the control electrode of an output transistor coupled between a voltage source and the output of said voltage regulator;

a first feedback loop means coupling the output of said voltage regulator circuit to the control electrode of said second differential transistor; and a second feedback loop means coupled to the control electrode of said control transistor to compare the output voltage to said reference voltage driving the first differential transistor to generate a differential current and provide a drive, via said second and third current mirrors, to the control of the output transistor to produce an output capable of driving the gate of the control transistor from ground to voltage thereby providing wide bandwidth, high current, and loop stability to the voltage regulator circuit.

14. The regulator of claim 13 wherein said differential transistors are PMOS transistors.

15. The regulator of claim 14 wherein the first of said current mirrors is coupled to the first electrode of the transistor-capacitor and the second electrode of said transistor-capacitor is coupled to ground.

16. The regulator of claim 14 wherein the first of said current mirrors is coupled to the second electrode of the transistor-capacitor and the first electrode of said transistor-capacitor is coupled to a positive voltage.

17. The regulator of claim 13 wherein said differential transistors are NMOS transistors.

18. The regulator of claim 17 wherein the first of said current mirrors is coupled to the first electrode of the transistor-capacitor and the second electrode of said transistor-capacitor is coupled to ground.

19. The regulator of claim 17 wherein the first of said current mirrors is coupled to the second electrode of the transistor-capacitor and the first electrode of said transistor-capacitor is coupled to a positive voltage.

* * * * *